252-99 AU 165 EX
6/8/76 OR 3,962,106

United States Patent [19]

Rubin et al.

[11] 3,962,106

[45] June 8, 1976

[54] METHOD FOR AGGLOMERATING CHLOROCYANURATES

[75] Inventors: Fred K. Rubin, Leonia; Donald V. Kinsman, Tenafly, both of N.J.

[73] Assignee: Lever Brothers Company, New York, N.Y.

[22] Filed: Aug. 1, 1974

[21] Appl. No.: 493,599

[52] U.S. Cl. ..... 252/99; 23/313 R; 252/95; 252/97; 252/DIG. 11; 427/3; 427/213; 427/215

[51] Int. Cl.[2] ..... C11D 7/54

[58] Field of Search ..... 252/99, 95, 97, 103, 252/DIG. 11; 23/313; 427/3, 213, 215

[56] References Cited

UNITED STATES PATENTS

| | | | |
|---|---|---|---|
| 2,480,579 | 8/1949 | Holuba | 252/89 X |
| 3,042,621 | 7/1962 | Kirschenbauer | 252/99 |
| 3,306,858 | 2/1967 | Oberle | 252/99 |
| 3,637,509 | 1/1972 | Brennan et al. | 252/99 |

*Primary Examiner*—Mayer Weinblatt
*Attorney, Agent, or Firm*—Kenneth F. Dusyn; James J. Farrell; Arnold Grant

[57] ABSTRACT

A method is disclosed for the agglomeration of chlorocyanurates. The method involves contacting said chlorocyanurates with salts that are non-reactive with it. The chlorocyanurate particles so treated have an increased storage stability and a significantly decreased tendency to segregate when ultimately mixed with a detergent base.

12 Claims, No Drawings

METHOD FOR AGGLOMERATING CHLOROCYANURATES

BACKGROUND OF THE INVENTION

This invention relates to a method of treating chlorocyanurates and other N-chloro compounds so that when blended with a detergent base they will not segregate. An additional advantage that is gained from the instant invention is that of storage stability. In other words, the contact with and reaction between the chlorocyanurates and the surfactant and/or builder constitutents of a detergent base are greatly minimized.

The method of agglomeration disclosed and claimed herein is primarily geared to chlorocyanurate particles which will ultimately be utilized in detergent compositions containing little or no phosphate builders. However, adaptation of the disclosed method for use in phosphate detergent compositions is not precluded.

DESCRIPTION OF THE PRIOR ART

The polychlorocyanurates, i.e., tri- and di-chloro cyanuric acids and the alkali metal salts of dichlorocyanuric acid, have found wide acceptance as stable and efficient dry organic bleaching compounds. The polychlorocyanurates are usually mixed with dry inorganic salts, preferably alkaline salts, as carrier agents to provide bulk for ease in measuring and for prevention of localized over-concentration and preferably to provide alkalinity when the bleaching compound is dissolved in water. It has been found that polychlorocyanurates provide the greatest bleaching activity in water under alkaline conditions.

Mechanical mixtures of polychlorocyanurates and inorganic carrier agents are not satisfactory because of a definite tendency for stratification to occur in the packaged dry composition when it is moved or shipped because of the inherent difference in particle size and density of the polychlorocyanurates and the carrier agents. Commercially available polychlorocyanurates are usually fine dusty particles. Stratification of the polychlorocyanurate and the carrier agent is very undesirable, since users are unable to obtain uniform results with portions of the composition taken from different parts of the package.

In order to produce a dry substantially homogeneous mixture of a polychlorodyanurate and an inorganic carrier agent that will not stratify when packaged, aqueous slurries of the polychlorocyanurate and the carrier agent have been dried, usually by spray drying. Forming and drying such aqueous slurries, particularly spray drying, have caused substantial difficulties.

When polychlorocyanurates are incorporated in aqueous slurries preparatory to drying, there is a loss of available chlorine because of hydrolysis, thus undesirably reducing the effectiveness of the compounds. The elevated temperatures then used to eliminate the water from such slurries, particularly those temperatures used in spray drying cause additional loss of available chlorine. Spray drying of slurries containing polychlorocyanurates is also complicated by the corrosive action of the polychlorocyanurates on the crutchers, spray nozzles and spray towers.

The polychlorocyanurate in dry bleach compositions dried in accordance with the usual methods, such as by spray drying, are not protected or are only partially protected from moisture and air which are known to increase the tendency of such compounds to decompose. For example, the process of spray drying a homogeneous aqueous slurry of a polychlorocyanurate and an inorganic carrier agent effects a combination of the two ingredients in a granule which is usually hollow. Polychlorocyanurate in a spray dried granule will be exposed on the entire surface of the granule. Only the polychlorocyanurate in the interior of the granule will be protected by the carrier agent. Thus, the exposed polychlorocyanurate is subject to attack not only from moisture and air but from reactive materials with which the chlorine compound may be contacted such as strongly alkaline materials, organic foaming agents, optical brighteners and the like. Exposed polychlorocyanurate also provides a distinct chlorine odor to which some people might object and which would interfere with desired perfuming. The use of organic coating materials such as waxes, soaps, paraffins, fatty alcohols and the like is undesirable because of the reactivity of such materials with the polychlorocyanaurates, because coating with such materials is difficult, and because such materials tend to leave a residue in the water in which the polychlorocyanurate is used.

The preparation of agglomerates of chlorocyanurates by coating same with aqueous slurries of inorganic salts in a fluidized bed is taught in a patent to Morgenthaler et al., U.S. Pat. No. 3,112,274, the disclosure of which is incorporated herein by reference. A. U.S. patent to Brenner et al., U.S. Pat. No. 3,637,509, describes the coating or encapsulation of a particle combination composed of an organic chlorinating agent and an alkali metal tripolyphosphate with tetrapotassium pyrophosphate. The so coated particle is then admixed with a low-foaming surfactant. The disclosure of this patent is incorporated herein by reference. Belgian Pat. No. 803,751, published Feb. 2, 1974, describes the stabilization of N-haloimides by use of anhydrous sodium acetate, the disclosure of this publication is incorporated herein by reference.

The preparation and various forms of the chlorocyanurates are discussed in U.S. Pat. Nos. 2,607,738 and 2,913,460, the disclosures of which are incorporated herein by reference.

DESCRIPTION OF THE INVENTION

The terms chlorocyanurate and chloroisocyanurate will be used interchangeabley herein. Chlorocyanurate and other N-chloro compounds are marketed as fine powders, minute granules or small flakes. Because of differences in particle size, shape and density, severe segregation or stratification may occur when N-chloro compounds in "as marketed" form are admixed with granular detergent products, particularly those produced by agglomeration or spray dry processes. To obviate this difficulty and its attendant undesirable effects on product performance, we have developed what we believe to be a novel method of agglomerating small chlorocyanurate particles into larger granules which may be blended with a granular base without tendency to segregate.

Compositional non-uniformity resulting from segregation may be further minimized by increasing the proportion of chlorine releasing agent in the detergent composition. The presence of a small quantity of a conventional highly concentrated chlorine releasing agent, e.g., in automatic dishwasher detergent compositions, will accentuate compositional non-uniformity resulting from segregation of the chlorine releasing agent. Increasing the quantity of chlorine releasing agent will minimize the effect of segregation. To produce an increase in the chlorine releasing component without concomitant increase in the available chlorine of the total detergent composition, we have prepared "dilute" chlorine releasing agents by co-agglomerating commercially available chlorocyanurates with certain nonreactive salts. An example of this technique is the product obtained by agglomerating a dry blend of sodium dichloroisocyanurate and sodium sulfate with a concentrated solution of sodium sulfate.

It is therefore an object of the instant invention to provide a method of agglomerating salts of chlorocyanuric acid from the group consisting of sodium and potassium dichlorocyanurate, sodium dichlorocyanurate dihydrate and [(monotrichloro)-tetra-(monopotassium dichloro)]pentaisocyanurate, said method resulting in an agglomerated particle having increased storage stability and compositional uniformity when admixed with a detergent base, which method comprises the steps of: (1) contacting said salts of chlorocyanuric acid with an agglomerating liquid, said liquid being a concentrated solution of compounds selected from the group consisting of potassium citrate monohydrate, sodium citrate dihydrate, sodium acetate trihydrate, anhydrous sodium sulfate, wherein the solution ranges from about 10% to a saturated solution of said compounds, said contacting being conducted in a continuously moving bed so as to allow intimate contact of said salts of chlorocyanuric acid with said agglomerating liquid, the ratios of said salt to said liquid ranging from about 2:1 to about 4:1 by weight, (ii) drying the resultant agglomerated particles, and (iii) passing said agglomerated particles through a sieve, said sieve mesh size corresponding to the particle size of said granular detergent base to which the agglomerated particles are added.

A further objective of our invention is to improve the storage stability of detergent compositions containing chlorinating agents by minimizing contact and reaction between chlorinating agent and surfactants, organic builders or other chlorine reactive components of the detergent composition. Minimization of contact and reaction is obtained by coating or enveloping the chlorinating agent during the agglomeration process with certain non-phosphate salts. A reduction in the exposed surface area of the chlorinating agent is thus obtained which diminishes the interaction of chlorine with surfactant or organic builder and thereby insures greater product stability.

A still further object of the invention is the provision of detergent compositions, e.g., dishwashing, bleaching, scouring, containing the agglomerated particles made by the method herein disclosed and claimed.

It is essential that the salts utilized in the instant invention be employed in the form of concentrated solutions, preferably near their saturation point, to insure optimum stability of the agglomerated chlorocyanurates. It is, of course, understood that a saturated solution is a solution containing the maximum proportion of solute to solvent at that temperature under equilibrium conditions; in other words, a solution that does not change in concentration when brought into contact with an excess of the undissolved solute. Although the prior art seems to suggest that a wide variety of water-soluble salts may be used to agglomerate chlorocyanurate granules, we have found that some salts will adversely affect the stability of agglomerated chlorocyanurates, regardless of how concentrated a solution is employed during agglomeration. Among the unsuitable salts there are some which are commonly employed in the preparation of detergent products, e.g., sodium silicate and sodium carbonate. The lower chlorine stability of agglomerates prepared from such salts will be illustrated in subsequent examples. A typical concentration of the agglomeration solution will range from a 10% solution of the salts to a saturated solution. The salts used in the agglomerating solution are selected from sodium citrate dihydrate, anhydrous sodium sulfate, sodium acetate trihydrate, and potassium citrate monohydrate. The amount of agglomerating liquid in relation to the chlorocyanurate will range from 1:2 to about 1:4, preferably about 1:3, on a wt/wt basis.

In addition to the salts specifically mentioned, the non-hydrated forms of the citrates and acetates may also be used as well as other forms of sodium sulfate.

The contacting of the chlorocyanurates may be accomplished by spraying the chlorocyanurates with a mist of the agglomerating liquids. The contacting may also be accomplished by pouring or dripping the liquid onto the chlorocyanurates. Whichever way the contacting is accomplished, the chlorocyanurate particles should be constantly in motion, e.g., on a moving bed, so that there is intimate contact between the particles and the agglomerating liquid. The agglomerated particles are then dried either by air drying at ambient temperature or by the passage of warm air thereover and subsequently admixed with a detergent base. The coated/agglomerated chlorocyanurate particles of our invention may be employed in place of the conventional chlorocyanurate chlorine source in built and nonbuilt detergent, bleach and scouring compositions. As will be shown in subsequent examples, to prepare said compositions, the agglomerated chlorocyanurate particles of the present invention are dry blended with a chlorine-free base which may consist of a simple mechanical ingredient mix or of agglomerated or spray-dried particles. It should be noted at this point that the attendant problems associated with spray drying a slurry containing the chlorocyanurates is avoided by the instant invention. The chlorine-free base, in addition to builders, may contain silicates to provide alkalinity, and detergency and protect glazes and metals. The base further may contain surfactants of the nonionic, anionic or zwitterionic type or combinations thereof and an inert filler. The final compositions, additionally, may contain optional ingredients such as corrosion inhibitors, defoamers, dispersants, abrasive, colorants, perfumes and other ingredients well known to the art.

In non-phosphate compositions, the phosphate builder may be replaced with sequestrant or precipitant builders or combinations thereof. In unbuilt compositions, the absence of builder is compensated by high levels of surfactant materials. The major ingredients of non-phosphate automatic dishwasher detergent and bleach compositions are listed below:

BUILDERS

The following builders fall within the scope of our invention, but are not limiting: alkali metal citrates, alkali metal gluconates, ethylene diamine tetraacetates, polyphosphonates, nitrilotriacetates, alkali metal succinates and hydroxysuccinates, carboxymethyloxysuccinates, sodium oxydiacetate, polymaleates, polyaconitates, polyitaconates, polymesoconates, polymethylene malonates, alkali metal carbonates, bicarbonates, sesquicarbonates, alkali metal borates (tetra, meta). The builder range may vary from 0–85% by weight of the total composition.

SILICATES

These include dry and liquid silicates with $M_2O$: $SiO_2$ ratios from 1:1 to 1:3.5. The silicate content may vary from 0–80% by weight (where M is an alkali metal).

SURFACTANTS

Surfactants which fall within the scope of our invention include, but are not limited to, the following:

NONIONICS

Condensates of ethylene oxide with a hydrophobic base formed by the condensation of a propylene oxide with propylene glycol; polyethylene oxide condensates of alkyl phenols; polyoxyalkylene glycols; condensates of ethylene oxide with the reaction product of propylene oxide and ethylene diamine; ethoxylated higher alcohols; long chain tertiary amine oxides; long chain tertiary phosphine oxides; dialkyl sulfoxides.

Well known products such as Rohm & Haas' Triton brands or Wyandotte's Pluronic, Plurafac and Pluradot brands fall within the above generic list of nonionics.

ANIONICS

Alkali metal alkyl sulfates, alkali metal alkyl benzenesulfonates, alkyl diphenyl ether disulfonates, alkyl glyceryl ether sulfonates, alkali metal taurates, coconut oil fatty acid monoglyceride sulfates and sulfonates, alkali metal salts of sulfuric acid esters of the reaction product of a higher fatty alcohol with ethylene oxide, reaction products of fatty acids esterified with isethionic acid and neutralized with sodium hydroxide, alkane sulfonates derived from $\alpha$-olefins, alkali metal salts of alkyl phenol ethylene oxide ether sulfate, sodium benzene sulfonate, sodium xylene sulfonate, sodium naphthalene sulfonate.

ZWITTERIONICS

Derivatives of aliphatic quaternary ammonium compounds, sulfonium compounds and phosphonium compounds in which the aliphatic radical may be straight chain or branched and wherein one of the aliphatic substituents contains from about 8 to 18 carbon atoms and one contains an anionic water solubilizing group.

SOAP

Sodium and potassium salts of higher fatty acids. The surfactant content may range between 0.2% and 65% by weight.

FILLERS

Fillers may be represented by alkali metal sulfates, chlorides, borates, carbonates, sesquicarbonates and other inert ingredients well known to the art. Fillers may comprise 0–95% by weight of the composition.

Other detergent base components that may be utilized in the instant invention are disclosed in U.S. Pat. No. 3,794,605 to Diehl, the disclosure of which is incorporated herein by reference.

CHLORINE SOURCES

The chlorine sources of the described compositions are the coated/agglomerated chlorocyanurates which represent the substance of our invention. The following chlorocyanurates (=chloroisocyanurates) may be employed as starting materials in the agglomeration process: potassium dichlorocyanurate, sodium dichlorocyanurate, sodium dichlorocyanurate dihydrate, [(monotrichloro)-tetra-(monopotassium dichloro)]-pentaisocyanurate.

The invention and its application will be illustrated by the following non-limiting Examples.

EXAMPLE 1

CHLORINE RELEASING COMPOSITIONS

Pulverulent or minute granular particles of chloroisocyanurate were sprayed with a mist of one of the agglomerating liquids shown in the table of formulas (Table I). As an alternative to spraying, the agglomerating solutions were dripped on the chloroisocyanurate powders. During spraying or dripping, the powder bed was kept in continuous motion to allow intimate contact of powder particles with agglomerating liquid. After a satisfactory degree of agglomeration had been reached, spraying or dripping was discontinued and the agglomerates allowed to dry. While air drying at ambient temperatures was found to be rapid and generally satisfactory, blowing warm air over the agglomerated products promoted the drying process. The dried agglomerates were passed through powder sieves, the sieve mesh sizes corresponding to the particle size of the respective chlorine-free base to which the agglomerated chlorine releasing composition was to be added.

TABLE I

| | CHLORINE RELEASING COMPOSITIONS PERCENT BY WEIGHT | | | | | | | |
|---|---|---|---|---|---|---|---|---|
| Solid Components | I | II | III | IV | V | VI | VII | VIII |
| Potassium dichloroisocyanurate | 80.5 | 75.7 | — | 74.6 | 79.1 | — | — | — |
| Sodium dichloroisocyanurate | — | — | — | — | — | — | 69.4 | — |
| Sodium dichloroisocyanurate dihydrate | — | — | 75.2 | — | — | 40.5 | — | — |
| [(Monotrichloro)-tetra-(monopotassium dichloro)] penta-isocyanurate | — | — | — | — | — | — | — | 75.8 |
| Sodium sulfate anhydrous | — | — | — | — | — | 40.5 | — | — |
| Ultramarine Blue Colorant | 1.0 | — | — | — | — | — | — | — |
| Agglomerating Liquids | | | | | | | | |
| Sodium citrate dihydrate (41.7% solution) | 18.5 | — | 24.8 | — | — | — | — | — |
| Potassium citrate monohydrate (61.0% solution) | — | 24.3 | — | — | — | — | — | — |
| Sodium sulfate anhydrous (21.5% solution) | — | — | — | 25.4 | — | 19.0 | 30.6 | — |
| Sodium acetate trihydrate (50.5% solution) | — | — | — | — | 21.4 | — | — | 24.2 |

TABLE I-continued

| Solid Components | CHLORINE RELEASING COMPOSITIONS PERCENT BY WEIGHT I | II | III | IV | V | VI | VII | VIII |
|---|---|---|---|---|---|---|---|---|
| % available chlorine initially | 50.28 | 47.60 | 46.29 | 47.54 | 51.44 | 22.08 | 44.19 | 50.44 |
| after storage at ambient conditions for (days) | 49.51 (30) | 47.72* (34) | 46.09 (29) | 48.10* (28) | 53.08* (29) | 22.28* (14) | 43.96 (17) | 52.03* (17) |
| % loss of available chlorine | 1.5 | 0 | 0.5 | 0 | 0 | 0 | 0.6 | 0 |

*Slightly higher than initial readings upon storage are result of incomplete drying and loss of moisture during storage.

EXAMPLE 2

The agglomerated chlorine releasing compositions shown below were prepared in the same manner as the compositions in Example 1, but they lack the stability of the latter. The stability difference is an indication of the specificity of the salts employed to agglomerate chlorocyanurates.

| Solid Component | Percent By Weight IX | X |
|---|---|---|
| Potassium dichloroisocyanurate | 65.4 | 76.6 |
| Agglomerating Liquids | | |
| Sodium silicate 3.22 ratio (38.1% solution) | 34.6 | — |
| Sodium carbonate (22% solution) | — | 23.4 |
| | 100.0 | 100.0 |
| % available chlorine | 35.24 | 49.39 |
| after storage at ambient conditions for (days) | 30.44 (30) | 44.95 (24) |
| % loss of available chlorine | 13.6 | 9.0 |

EXAMPLES 3–10

Phosphate-free automatic dishwasher detergent compositions may be prepared by blending the Chlorine Releasing Compositions described in Example 1 with the Non-Chlorinated Phosphate-Free Detergent Bases shown in Table II below. The bases are prepared by a dry mixing process. Before blending, the Chlorine Releasing Compositions are sized by passing through a 20 mesh (U.S.S.) sieve.

| Example No. | PARTS BY WEIGHT Non-chlorinated, Phosphate-Free Detergent Base | Chlorine Releasing Composition (as per Example 1) |
|---|---|---|
| 3 | 98.2 A | 1.8 I |
| 4 | 98.2 B | 1.8 I |
| 5 | 98.1 D | 1.9 II |
| 6 | 98.1 A | 1.9 III |
| 7 | 98.1 C | 1.9 IV |
| 8 | 95.9 E | 4.1 VI |
| 9 | 98.0 A | 2.0 VII |
| 10 | 98.2 B | 1.8 VIII |

The above proportions will yield approximately .9% available chlorine in the final detergent compositions. Other proportions, to yield higher or lower available chlorine values, are within the ambit of this invention.

While only essential components are shown in the detergent compositions of Examples 3–10, colorants, perfumes, dispersants, defoamers, etc. may be included without detracting from the spirit of the invention.

EXAMPLE 11

A non-phosphate, detergent composition suitable for automatic dishwashing, may be prepared by blending:

2 parts Chlorine Releasing Composition IV (Example 1)

98 parts Agglomerated Base

The agglomerated Base is prepared by spraying its liquid ingredients onto a moving bed of the solid ingredients. The Agglomerated Base is composed of:

TABLE II

| NON-CHLORINATED, PHOSPHATE-FREE DETERGENT BASES PERCENT BY WEIGHT | A | B | C | D | E |
|---|---|---|---|---|---|
| Sodium citrate dihydrate | 26.0 | 27.0 | — | — | — |
| Potassium citrate monohydrate | — | — | — | 5.0 | — |
| Sodium sulfosuccinate (active) | — | — | 35.0 | — | — |
| Sodium nitrilotriacetate monohydrate | — | — | — | — | 38.0 |
| Hydrous polysilicate, 2.0 ratio | — | 32.0 | 16.0 | — | 16.0 |
| (1) HA sodium silicate, 2.4 ratio | — | — | 16.0 | 35.0 | — |
| Sodium metasilicate, anhydrous | 10.0 | — | — | — | — |
| Sodium carbonate | 25.0 | — | — | — | — |
| Sodium sulfate | 33.0 | 38.0 | 24.0 | 46.0 | 42.9 |
| (2) Triton DF-12 | — | 3.0 | — | — | 2.4 |
| (3) Plurafac RA-43 | — | — | — | 14.0 | — |
| (4) Pluronic L-62D | 4.0 | — | — | — | — |
| (4) Pluronic L-61 | 2.0 | — | 6.0 | — | — |
| (5) Igepon CN-42 (active) | — | — | 3.0 | — | — |
| (6) Dowfax 2A-1 (active) | — | — | — | — | 0.7 |
| | | | 100.0 | | |

(1) HA Sodium silicate represents a dry sodium silicate of high non-aqueous liquid absorbency. In commercial development by duPont.

(2) Triton DF-12: Rohm & Haas' tradename for a polyethoxylated straight-chain alcohol.

(3) Plurafac RA-43: BASF/Wyandotte's tradename for an oxyethylated straight-chain alcohol containing monostearyl acid phosphate.

(4) Pluronic L-62D and L-61: BASF/Wyandotte's tradename for ethylene oxide/propylene oxide block copolymers.

(5) Igepon CN-42: GAF's tradename for sodium N-cyclohexyl-N-palmitoyl taurate.

(6) Dowfax 2A-1: Dow Chemical Company's tradename for sodium dodecyl diphenylether disulfonate.

| | Parts by Weight |
|---|---|
| Carboxymethyloxysuccinate | 44.75 |
| Sodium sulfate | 24.40 |
| Sodium silicate liquid, 3.22 ratio (38.1% solids) | 15.00 |
| Sodium silicate liquid, 2.4 ratio (46.8% solids) | 12.56 |
| Antarox BL-330 | 3.00 |
| Water | 2.75 |
| | 102.46 |

The Agglomerated Base is dried in a rotating vessel or by a fluidized bed process. During drying, approximately 2.5 parts moisture per 100 parts Base are lost.

Prior to blending, Base and Chlorine Releasing Composition are screened to −10 + 60 mesh (U.S.S.) size.

The final detergent composition yields approximately 0.95% available chlorine.

EXAMPLES 12–14

To prepare dry bleach compositions, the spray-dried Bleach Base shown below is being blended with Chlorine Releasing Compositions I, III or IV shown in Example 1. Prior to blending, the Chlorine Releasing Compositions are passed through a 20 mesh (U.S.S.) sieve.

| Spray Dried Bleach Base | Percent By Weight |
|---|---|
| Sodium citrate dihydrate | 35.00 |
| Linear alkyl benzenesulfonate | 25.00 |
| Sodium silicate, 2.4 ratio (active) | 8.00 |
| Carboxymethylcellulose | 0.32 |
| Sodium sulfate | 25.60 |
| Fluorescers and colorants | 0.15 |
| Moisture and Misc. | 5.93 |
| | 100.00 |

The final bleaching compositions consist of:

| | PERCENT BY WEIGHT | | |
|---|---|---|---|
| | Example 12 | Example 13 | Example 14 |
| Chlorine Releasing Composition I | 20 | — | — |
| Chlorine Releasing Composition III | — | 20 | — |
| Chlorine Releasing Composition IV | — | — | 20 |
| Spray Dried Bleach Base | 80 | 80 | 80 |
| | 100 | 100 | 100 |
| % available chlorine | 9.95 | 9.26 | 9.51 |

EXAMPLE 15

A scouring cleanser may be prepared by blending the coated chloroisocyanurate particles illustrated by Chlorine Releasing Composition V (Example 1) with a mechanically mixed scourer base:

| | Parts By Weight |
|---|---|
| Chlorine Releasing Composition V | 1.0 |
| Scourer Base | 99.0 |
| | 100.00 |

| Scourer Base | Percent By Weight |
|---|---|
| Linear alkyl benzene sulfonate (active) | 2.5 |
| Sodium carbonate | 10.0 |
| Silica abrasive | 87.5 |
| | 100.0 |

Prior to blending, Chlorine Releasing Composition V was passed through an 80 mesh (U.S.S.) screen.

What is claimed is:

1. A method of agglomerating salts of chlorocyanuric acid selected from the group consisting of sodium and potassium dichlorocyanurate, sodium dichlorocyanurate dihydrate and [(monotrichloro)-tetra-(monopotassium dichloro)]pentaisocyanurate, said method resulting in an agglomerated particle having increased storage stability and compositional uniformity when admixed with a detergent base, which method comprises the steps of:

i. contacting said salts of chlorocyanuric acid with an agglomerating liquid, said liquid being a concentrated solution of compounds selected from the group consisting of potassium citrate monohydrate, sodium citrate dihydrate, sodium acetate trihydrate, anhydrous sodium sulfate, wherein the solution ranges from about 10% to a saturated solution of said compounds, said contacting being conducted in a continuously moving bed so as to allow intimate contact of said salts of chlorocyanuric acid with said agglomerating liquid, the ratios of said salt to said liquid ranging from about 2:1 to about 4:1 by weight, ii. drying the resultant agglomerated particles, and iii. passing said agglomerated particles through a sieve, said sieve mesh size corresponding to the particle size of said granular detergent base to which the agglomerated particles are added.

2. The method of claim 1 wherein the ratio of salt of chlorocyanuric acid to the agglomerating liquid is about 3:1.

3. The method of claim 1 wherein the salt is potassium dichlorocyanurate and the agglomerating liquid is a solution of sodium citrate dihydrate.

4. The method of claim 1 wherein the salt is potassium dichlorocyanurate and the agglomerating liquid is a solution of potassium citrate monohydrate.

5. The method of claim 1 wherein the salt is potassium dichlorocyanurate and the agglomerating liquid is a solution of anhydrous sodium sulfate.

6. The method of claim 1 wherein the salt is potassium dichlorocyanurate and the agglomerating liquid is a solution of sodium acetate trihydrate.

7. The method of claim 1 wherein the salt is sodium dichlorocyanurate and the agglomerating liquid is a solution of anhydrous sodium sulfate.

8. The method of claim 1 wherein the salt is sodium dichlorocyanurate dihydrate and the agglomerating liquid is a solution of sodium citrate dihydrate.

9. The method of claim 1 wherein the salt is a mixture of sodium dichlorocyanurate and anhydrous sodium sulfate and the agglomerating liquid is a solution of anhydrous sodium sulfate.

10. The method of claim 1 wherein the salt is [(monotrichloro)-tetra-(monopotassium dichloro)]-pentacyanurate and the agglomerating liquid is a solution of sodium acetate trihydrate.

11. The method of claim 1 wherein the detergent base comprises from i. 0–85% by weight of said base of a detergent builder selected from the group consisting of alkali metal citrates, alkali metal gluconates, ethylene diamine tetraacetate, polyphosphonates, nitrilotriacetates, alkali metal succinates and hydroxysuccinates, carboxymethyloxysuccinates, sodium oxydiacetate, polymaleates, polyaconitates, polyitaconates, polymesoconates, polymethylene malonates, alkali metal carbonates, bicarbonates, sesquicarbonates, and alkali metal borates (tetra, meta), ii. 0–80% by weight of said base of an alkali metal silicate wherein the ratio of $M_2O:SiO_2$ being from about 1:1 to about 1:3.5 and where M is an alkali metal, iii. from about 0.2% to about 65% by weight of said base of a surfactant selected from the group consisting of soap, anionic, nonionic and zwitterionic detergents, iv. 0–95% of a filler selected from the group consisting of alkali metal sulfates, chlorides, borates, carbonates, and sesquicarbonates, and, v. the balance comprising corrosion inhibitors, defoamers, dispersants, abrasives, colorants, and perfumes.

12. A detergent composition having increased storage stability and compositional uniformity, said composition comprising:

a. from about 1% to about 20% of an agglomerated particle said particle being obtained by contacting a salt of chlorocyanuric acid selected from the group consisting of sodium and potassium dichlorocyanurate, sodium dichlorocyanurate dihydrate and [(mono-trichloro)-tetra-(monopotassium dichloro)]pentaisoyanurate with an agglomerating liquid, which is a concentrated solution of compounds selected from the group consisting of potassium citrate monohydrate, sodium citrate dihydrate, sodium acetate trihydrate, anhydrous sodium sulfate, wherein the solution ranges from about 10% to a saturated solution of said compounds, said contacting being conducted in a continuously moving bed so as to allow intimate contact of said salt of chlorocyanuric acid with said agglomerating liquid, the ratios of said salt to said liquid ranging from about 2:1 to about 4:1 by weight, and b. from about 99% to about 80% of a detergent base, said base comprising:

i. 0–85% by weight of said base of detergent builders selected from the group consisting of alkali metal citrates, alkali metal gluconates, ethylene diamine tetraacetate, polyphosphonates, nitrilotriacetates, alkali metal succinates and hydroxysuccinates, carboxymethyloxysuccinates, sodium oxydiacetate, polymaleates, polyaconitates, polyitaconates, polymesaconates, polymethylene malonates, alkali metal carbonates, bicarbonates, sesquicarbonates, and alkali metal borates (tetra, meta), ii. 0–80% by weight of said base of an alkali metal silicate wherein the ratio of $M_2O:SiO_2$ being from about 1:1 to about 1:3.5 and where M is an alkali metal, iii. from about 0.2% to about 65% by weight of said base of a surfactant selected from the group consisting of soap, anionic, nonionic and zwitterionic detergents, iv. 0–95% of a filler selected from the group consisting of an alkali metal sulfate, a chloride, a borate, a carbonate and a sesquicarbonate, and v. the balance comprising corrosion inhibitors, defoamers, dispersants, abrasives, colorants, and perfumes.

* * * * *